US006452476B1

(12) United States Patent
Handa

(10) Patent No.: US 6,452,476 B1
(45) **Date of Patent: *Sep. 17, 2002**

(54) ORGANIC POSITIVE TEMPERATURE COEFFICIENT THERMISTOR

(75) Inventor: Tokuhiko Handa, Tokyo (JP)

(73) Assignee: TDK Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/238,920

(22) Filed: Jan. 28, 1999

(51) Int. Cl.[7] ..... H01C 7/10; H01C 7/13

(52) U.S. Cl. ..... 338/22 R; 338/20; 252/511; 252/513

(58) Field of Search ..... 338/22 R, 20, 338/225 D; 252/511, 512, 513, 518, 519

(56) References Cited

U.S. PATENT DOCUMENTS 4,236,976 A * 12/1980 Kohl ..... 204/15
4,430,386 A * 2/1984 Watanabe et al. ..... 428/555
4,545,926 A * 10/1985 Fout, Jr. et al. ..... 252/511
4,977,309 A * 12/1990 Uchida ..... 219/541
5,174,924 A * 12/1992 Yamada et al. ..... 252/511
5,216,114 A * 6/1993 Walles et al. ..... 528/173
5,378,407 A * 1/1995 Chandler et al. ..... 252/513
5,378,533 A * 1/1995 Ota ..... 428/304.4
5,874,885 A * 2/1999 Chandler et al. ..... 338/22 R
5,945,034 A * 8/1999 Handa et al. ..... 252/511

FOREIGN PATENT DOCUMENTS

| | | |
|---|---|---|
| JP | 3-132001 | 6/1991 |
| JP | 5-198403 | 8/1993 |
| JP | 5-198404 | 8/1993 |
| JP | 7-22035 (3-205777) | 3/1995 |
| JP | 7-48396 (2-230684) | 5/1995 |
| JP | 2668426 (2-156502) | 7/1997 |

* cited by examiner

*Primary Examiner*—Elvin Enad
*Assistant Examiner*—Kyung S. Lee
(74) *Attorney, Agent, or Firm*—Oblon, Spivak, McClelland, Maier & Neustadt, P.C.

(57) ABSTRACT

The organic positive temperature coefficient thermistor of the invention comprises a thermosetting polymer matrix, a low-molecular organic compound and conductive particles, each having spiky protuberances, and so can have sufficiently low room-temperature resistance and a large rate of resistance change between an operating state and a non-operating state. In addition, the thermistor can have a small temperature vs. resistance curve hysteresis with no NTC behavior after resistance increases, ease of control of operating temperature, and high performance stability.

15 Claims, 4 Drawing Sheets

—X— HEATING

—O— COOLING

HEATING

COOLING

—X— HEATING

—O— COOLING

ORGANIC POSITIVE TEMPERATURE COEFFICIENT THERMISTOR

BACKGROUND OF THE INVENTION

1. Prior Art

The present invention relates to an organic positive temperature coefficient thermistor that is used as a temperature sensor or overcurrent-protecting element, and has PTC (positive temperature coefficient of resistivity) characteristics or performance that its resistance value increases with increasing temperature.

2. Background Art

An organic positive temperature coefficient thermistor having conductive particles dispersed in a crystalline thermoplastic polymer has been well known in the art, as typically disclosed in U.S. Pat. Nos. 3,243,753 and 3,351,882. The increase in the resistance value is thought as being due to the expansion of the crystalline polymer upon melting, which in turn cleaves a current-carrying path formed by the conductive fine particles.

An organic positive temperature coefficient thermistor can be used as a self control heater, an overcurrent-protecting element, and a temperature sensor. Requirements for these are that the resistance value is sufficiently low at room temperature in a non-operating state, the rate of change between the room-temperature resistance value and the resistance value in operation is sufficiently large, and the resistance value change upon repetitive operations is reduced.

To meet such requirements, it has been proposed to use a low-molecular organic compound such as wax and employ a thermoplastic polymer matrix for a binder. Such an organic positive temperature coefficient thermistor, for instance, includes a polyisobutylene/paraffin wax/carbon black system (F. Bueche, J. Appl. Phys., 44, 532, 1973), a styrene-butadiene rubber/paraffin wax/carbon black system (F. Bueche, J. Polymer Sci., 11, 1319, 1973), and a low-density polyethylene/paraffin wax/carbon black system (K. Ohe et al., Jpn. J. Appl. Phys., 10, 99, 1971). Self control heaters, current-limiting elements, etc. comprising an organic positive temperature coefficient thermistor using a low-molecular organic compound are also disclosed in JP-B's 62-16523, 7-109786 and 7-48396, and JP-A's 62-51184, 62-51185, 62-51186, 62-51187, 1-231284, 3-132001, 9-27383 and 9-69410. In these cases, the resistance value increase is believed to be due to the melting of the low-molecular organic compound.

One of advantages to the use of the low-molecular organic compound is that there is a sharp rise in the resistance increase with increasing temperature because the low-molecular organic compound is generally higher in crystallinity than a polymer. A polymer, because of being easily put into an over-cooled state, shows a hysteresis where the temperature at which there is a resistance decrease with decreasing temperature is usually lower than the temperature at which there is a resistance increase with increasing temperature. With the low-molecular organic compound it is then possible to keep this hysteresis small. By use of low-molecular organic compounds having different melting points, it is possible to easily control the temperature (operating temperature) at which there is a resistance increase. A polymer is susceptible to a melting point change depending on a difference in molecular weight and crystallinity, and its copolymerization with a comonomer, resulting in a variation in the crystallographic state. In this case, no sufficient PTC characteristics are often obtained.

In the organic positive temperature coefficient thermistors set forth in the above publications, however, no sensible tradeoff between low initial (room temperature) resistance and a large rate of resistance change is reached. Jpn. J. Appl. Phys., 10, 99, 1971 shows an example wherein the specific resistance value (Ω·cm) increases by a factor of $10^8$. However, the specific resistance value at room temperature is as high as $10^4$ Ω·cm, and so is impractical for an overcurrent-protecting element or temperature sensor in particular. Other publications show resistance value (Ω) or specific resistance (Ωcm) increases in the range between 10 times or lower and about 104 times, with the room-temperature resistance being not fully decreased.

A problem associated with using the thermoplastic polymer for the matrix is that because the matrix melts and fluidizes at the melting point of the polymer, the dispersion state of the system changes upon exposure to high temperature in particular, resulting in unstable performance.

On the other hand, JP-A's 2-156502, 2-230684, 3-132001 and 3-205777 disclose an organic positive temperature coefficient thermistor using a low-molecular organic compound and a thermosetting polymer behaving as a matrix. Since carbon black, and graphite are used as conductive particles, however, the rate of resistance change is as small as one order of magnitude or less and the room-temperature resistance is not sufficiently reduced or about 1 Ω·cm as well. Thus, no compromise is made between the low initial resistance and the large rate of resistance change.

JP-A's 55-68075, 58-34901, 63-170902, 2-33881, 9-9482 and 10-4002, and U.S. Pat. No. 4,966,729 propose an organic positive temperature coefficient thermistor constructed solely of a thermosetting polymer and conductive particles without recourse to a low-molecular organic compound. In these themistors, either, no compromise is achieved between a room-temperature resistance of up to 0.1 Ω·cm and a large rate of resistance change of 5 orders of magnitude greater, because carbon black, and graphite are used as the conductive particles. Generally, thermistor systems composed merely of a thermosetting polymer and conductive particles have no distinct melting point, and so many of them show a sluggish resistance rise in temperature vs. resistance performance, failing to provide satisfactory performance in overcurrent-protecting element, temperature sensor, and like applications in particular.

In many cases, carbon black, and graphite have been used as conductive particles in prior art organic positive temperature coefficient thermistors including those set forth in the above publications. A problem with carbon black is, however, that when an increased amount of carbon black is used to lower the initial resistance value, no sufficient rate of resistance change is obtainable; no reasonable tradeoff between low initial resistance and a large rate of resistance change is obtainable. Sometimes, particles of generally available metals are used as conductive particles. In this case, too, it is difficult to arrive at a sensible tradeoff between the low initial resistance and the large rate of resistance change.

One approach to solving this problem is disclosed in JP-A 5-47503 that teaches the use of conductive particles having spiky protuberances. More specifically, it is disclosed that polyvinylidene fluoride is used as a crystalline polymer and spiky nickel powders are used as conductive particles having spiky protuberances. U.S. Pat. No. 5,378,407, too, discloses a thermistor comprising filamentary nickel having spiky protuberances, and a polyolefin, olefinic copolymer or fluoropolymer. However, these thermistors are still insufficient in terms of hysteresis and so are unsuitable for applications such as temperature sensors, although the effect on the tradeoff between low initial resistance and a large resistance change is improved. This is because no low-molecular organic compound is used as a working or active substance. Another problem with these thermistors is that when they are further heated after the resistance increase upon operation, they show NTC (negative temperature coefficient of resistivity) behavior that the resistance value decreases with increasing temperature. It is to be noted that the above publications give no suggestion about the use of a low-molecular organic compound at all.

JP-A 5-198403 and 5-198404 disclose an organic positive temperature coefficient thermistor comprising a mixture of a thermosetting resin and conductive particles having spiky protuberances, and show that the rate of change resistance obtained is 9 orders of magnitude greater. However, when the room-temperature resistance value is lowered by increasing the amount of a filler, no sufficient rate of resistance change is obtained. Thus, it is difficult to achieve a tradeoff between low initial resistance value and a large resistance change. Also, the thermistors fail to show a sufficiently sharp resistance rise because of being composed of the thermosetting resin and conductive particles. The above publications, too, are silent about the use of a low-molecular compound.

SUMMARY OF THE INVENTION

An object of the invention is to provide an organic positive temperature coefficient thermistor that has sufficiently low resistance at room temperature and a large rate of resistance change between an operating state and a non-operating state, and can operate with a reduced temperature vs. resistance curve hysteresis, no NTC behavior after a resistance increase, ease of control of operating temperature, and high performance stability.

Such an object is achieved by the inventions defined below.

(1) An organic positive temperature coefficient thermistor comprising a thermosetting polymer matrix, a low-molecular organic compound and conductive particles, each having spiky protuberances. (2) The organic positive temperature coefficient thermistor according to (1), wherein said low-molecular organic compound has a melting point of 40 to 200° C. (3) The organic positive temperature coefficient thermistor according to (1), wherein said low-molecular organic compound has a molecular weight of 4,000 or lower. (4) The organic positive temperature coefficient thermistor according to (1), wherein said low-molecular organic compound is a petroleum wax or a fatty acid. (5) The organic positive temperature coefficient thermistor according to (1), wherein said thermosetting polymer matrix is any one of an epoxy resin, an unsaturated polyester resin, a polyimide, a polyurethane, a phenol resin, and a silicone resin. (6) The organic positive temperature coefficient thermistor according to (1), wherein a weight of said low-molecular organic compound is 0.2 to 2.5 times as large as a weight of said thermosetting polymer matrix. (7) The organic positive temperature coefficient thermistor according to (1), wherein said conductive particles, each having spiky protuberances, are interconnected in a chain form.

ACTION

In the present invention, the spiky shape of protuberances on the conductive particles enables a tunnel current to pass readily through the thermistor, and makes it possible to obtain initial resistance lower than would be possible with spherical conductive particles. When the thermistor is in operation, a large resistance change is obtainable because spaces between the spiky conductive particles are larger than those between spherical conductive particles.

In the present invention, the low-molecular organic compound is incorporated in the thermistor so that the PTC (positive temperature coefficient of resistivity) performance that the resistance value increases with increasing temperature is achieved by the melting of the low-molecular organic compound. Accordingly, the temperature vs. resistance curve hysteresis can be more reduced than that obtained by the melting of a crystalline thermoplastic polymer. Control of operating temperature by use of low-molecular organic compounds having varying melting points, etc. is easier than control of operating temperature making use of a change in the melting point of a polymer. Unlike a thermistor using a thermosetting polymer as a working or active substance, the thermistor of the invention shows a sharp resistance rise upon operation.

Further, the present invention uses the thermosetting polymer as the matrix. When the thermistor of the invention is put in operation, the large resistance change is obtained making use of a large volume expansion of the low-molecular organic compound incidental to its melting. However, a thermistor element composed only of a low-molecular organic compound and conductive particles cannot retain shape upon operation because the melting viscosity of the low-molecular organic compound is low. To prevent fluidization of the low-molecular organic compound due to its melting when the thermistor element is in operation or prevent deformation of the thermistor element upon operation, it is thus required to disperse the low-molecular organic compound and conductive particles in the matrix polymer. When a thermoplastic polymer is used for this matrix polymer, a problem arises in conjunction with high-temperature stability in particular because the polymer melts at greater than its melting point. According to the invention wherein the thermosetting polymer is used for the polymer matrix to disperse the low-molecular organic compound and conductive particles in the insoluble and infusible three-dimensional matrix, the thermistor is much more improved in performance stability than a thermistor using a thermoplastic polymer, and so the thermistor can maintain the low room-temperature resistance and the large resistance change upon operation over an extended period of time.

When a thermistor using a thermoplastic polymer matrix is heated after its resistance has increased, there is found an NTC phenomenon in which the resistance value decreases with increasing temperature. Upon cooling, the thermistor shows a large temperature vs. resistance curve hysteresis that is the resistance decreases from a temperature higher than the melting point of the low-molecular organic compound. The fact that a thermistor is restored in resistance value at a temperature higher than the preset temperature can become a serious problem when it is used especially as a protective element. The NTC phenomenon is also found in a system using a thermoplastic resin and conductive particles. The resistance decrease appears to be because of the realignment of the conductive particles in the matrix in a molten state by a current continuing to pass through the thermistor even after a resistance increase. The same reason may also hold for the case where, upon cooling, the resistance value decreases from a temperature higher than the operating temperature upon heating. According to the present invention, the above problems, i.e., the NTC phenomenon occurring after the resistance increase and the temperature vs. resistance curve hysteresis, can be substantially eliminated by use of the insoluble and infusible thermosetting polymer matrix.

EXPLANATION OF THE PREFERRED EMBODIMENTS

Figure 1:
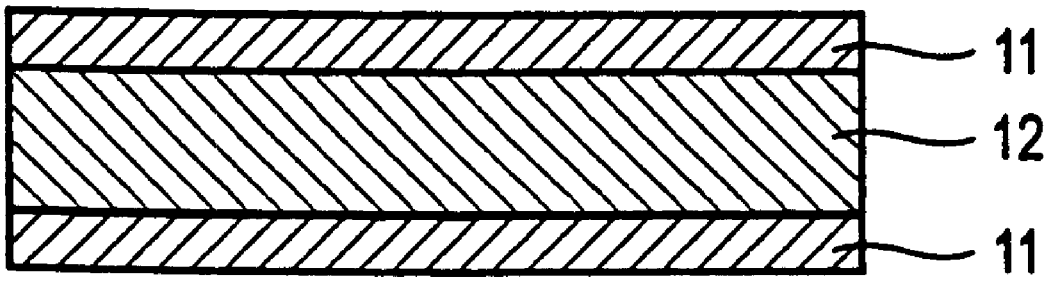
FIG. 1 is a sectional schematic of an organic positive coefficient thermistor.

The organic positive temperature coefficient thermistor of the invention comprises a thermosetting polymer matrix, a low-molecular organic compound and conductive particles having spiky protuberances.

Preferably but not exclusively, an epoxy resin, an unsaturated polyester resin, a polyimide, a polyurethane, a phenol resin, and a silicone resin are used for the thermosetting polymer matrix.

An epoxy resin is prepared by curing (crosslinking) an oligomer having a reactive epoxy terminal group (with a molecular weight of a few hundred to about 10,000) using various curing agents, and is broken down into a glycidyl ether type represented by bisphenol A, a glycidyl ester type, a glycidyl amine type, and an alicyclic type. In some applications, a trifunctional or polyfunctional epoxy resin may also be used. Among others, it is preferable to use the glycidyl ether type epoxy resin, with the bisphenol A type epoxy resin being most preferred. Preferably, the epoxy resin used herein has an epoxy equivalent of about 100 to 500. The curing agent is classified into a polyaddition type, a catalyst type and a condensation type depending on the reaction mechanism involved. The polyaddition type curing agent adds to an epoxy or hydroxyl group by itself, and includes polyamine, acid anhydride, polyphenol, polymercaptan, isocyanate, etc. The catalyst type curing agent catalyzes the polymerization of epoxy groups, and includes tertiary amines, imidazoles, etc. The condensation type curing agent condenses with a hydroxyl group for curing, and includes phenol resin, melamine resin, etc. In the invention, it is preferable to use the polyaddition type curing agent, especially a polyamine curing agent and an acid anhydride curing agent as the curing agent for the bisphenol A type epoxy resin. Curing conditions may be properly determined.

Such epoxy resins and curing agents are commercially available, for instance, including Epicoat (resin) and Epicure and Epomate (curing agents), all made by Yuka Shell Epoxy Co., Ltd., and Araldite made by Ciba-Geigy. An unsaturated polyester resin comprises a polyester (having a molecular weight of about 1,000 to 5,000) composed mainly of an unsaturated dibasic acid or a dibasic acid and a polyhydric alcohol and a crosslinking vinyl monomer in which the polyester is dissolved. Then, the solution is cured using an organic peroxide such as benzoyl peroxide as a polymerization initiator. For curing, polymerization promoters may be used if required. As the starting materials for the unsaturated polyester used herein, maleic anhydride and fumaric anhydride are preferable for the unsaturated dibasic acid, phthalic anhydride, isophthalic anhydride and terephthalic anhydride are preferred for the dibasic acid, and propylene glycol and ethylene glycol are preferred for the polyhydric alcohol. Styrene, diallyl phthalate and vinyltoluene are preferable for the vinyl monomer. The amount of the vinyl monomer maybe properly determined. However, it is usually preferred that the amount of the vinyl monomer is about 1.0 to 3.0 mol per fumaric acid residue. To prevent gelation and control curing properties, etc. in the synthesis process, known polymerization inhibitors such as quinones and hydroquinones may be used. Curing conditions may be properly determined.

Such unsaturated polyester resins are commercially available, for instance, including Epolac made by Nippon Shokubai Co., Ltd., Polyset made by Hitachi Kasei Co., Ltd., and Polylight made by Dainippon Ink & Chemicals, Inc.

A polyimide is generally broken down into a condensation type and an addition type depending on preparation processes. In the present invention, however, preference is given to a bis-maleimide type polyimide that is an addition polymerization type polyimide. The bis-maleimide type polyimide may be cured by making use of homopolymerization, a reaction with other unsaturated bond, a Michael addition reaction with aromatic amines, a Diels-Alder reaction with dienes, etc. Particular preference is given to a bis-maleimide type polyimide resin obtained by an addition reaction between bis-maleimide and aromatic diamines. The aromatic diamines include diaminodiphenylmethane, etc. Synthesis, and curing conditions may be properly determined.

Such polyimides are commercially available, for instance, including Imidaloy made by Toshiba Chemical Co., Ltd. and Kerimide made by Ciba-Geigy.

A polyurethane is obtained by a polyaddition reaction between polyisocyanate and polyol. The polyisocyanate is broken down into an aromatic type and an aliphatic type, with the aromatic type being preferred. Preference is given to 2,4- or 2,6-tolylene diisocyanate, diphenylmethane diisocyanate, naphthalene diisocyanate, etc. The polyol includes polyether polyol suc[0088] as polypropylene glycol, polyester polyol, acryl polyol, etc., with polypropylene glycol being preferred. The catalyst used herein may be an amine type catalyst (a tertiary amine catalyst such as triethylenediamine, and an amine salt catalyst). To this end, however, it is preferable to use an organic metal type catalyst such as dibutyltin dilaurate, and stannous octoate. The catalyst may be used in combination with an subordinate aid such as a crosslinking agent, e.g., polyhydric alcohol, and polyhydric amine. Synthesis, and curing conditions may be properly determined.

Such polyurethane resins are commercially available, for instance, including Sumijule made by Sumitomo Bayer Polyurethane Co., Ltd., NP series made by Mitsui Toatsu Chemicals, Inc., and Colonate made by Nippon Polyurethane, Co., Ltd.

A phenol resin is obtained by the reaction of phenol with an aldehyde such as formaldehyde, and is generally broken down into a novolak type and a resol type depending on synthesis conditions. The novolak type phenol formed under an acidic catalyst is cured if it is heated together with a crosslinking agent such as hexamethylenetetramine, and the resol type phenol resin formed under a basic catalyst is cured by itself with the application of heat or in the presence of an acidic catalyst. Both types may be used in the invention. Synthesis, and curing conditions may be properly determined.

Such phenol resins are commercially available, for instance, including Sumicon made by Sumitomo Bakelite Co., Ltd., Standlite made by Hitachi Kasei Co., Ltd., and Tecolite made by Toshiba Chemical Co., Ltd.

A silicone resin comprises a repetition of siloxane bonds, for instance, including a silicone resin obtained mainly by the hydrolysis or polycondensation of organohalosiloxane or silicone resins modified by alkyd, polyester, acrylic, epoxy, phenol, urethane, and melamine, silicone rubber obtained by crosslinking linear polydimethylsiloxane or its copolymer with an organic peroxide, etc., and a room-temperature vulcanizing (RTV) condensation or addition type silicone rubber.

Such silicone resins are commercially available, for instance, including various silicone rubbers and various silicone resins made by The Shin-Etsu Chemical Co., Ltd., Toray Dow Corning Co., Ltd., and Toshiba Silicone Co., Ltd.

The thermosetting resins used herein may be properly selected depending on the performance desired for the thermistor and the application of the thermistor. It is particularly preferable to use the epoxy resin and unsaturated polyester resin. Two or more resins may be polymerized together into a polymer.

Although the polymer matrix should preferably be composed solely of such a thermosetting polymer as mentioned above, it is in some cases acceptable to incorporate an elastomer and/or a thermoplastic resin in the thermosetting polymer.

Preferably but not exclusively, the low-molecular organic compound used herein is a crystalline yet solid (at normal temperature or about 25° C.) substance having a molecular weight of up to about 4,000, preferably up to about 1,000, and more preferably 200 to 800.

Such a low-molecular organic compound, for instance, includes waxes (e.g., petroleum waxes such as paraffin wax and microcrystalline wax as well as natural waxes such as vegetable waxes, animal waxes and mineral waxes), and fats and oils (e.g., fats, and those called solid fats). Actual components of the waxes, and fats and oils may be hydrocarbons (e.g., an alkane type straight-chain hydrocarbon having 22 or more carbon atoms), fatty acids (e.g., a fatty acid of an alkane type straight-chain hydrocarbon having 12 or more carbon atoms), fatty esters (e.g., a methyl ester of a saturated fatty acid obtained from a saturated fatty acid having 20 or more carbon atoms and a lower alcohol such as methyl alcohol), fatty amides (e.g., an amide of an unsaturated fatty amide such as oleic amide, and erucic amide), aliphatic amines (e.g., an aliphatic primary amine having 16 or more carbon atoms), higher alcohols (e.g., an n-alkyl alcohol having 16 or more carbon atoms), and paraffin chloride. However, these components may be used by themselves or in cobmination as the low-molecular organic compound. The low-molecular organic compound used herein should preferably be selected such that the components can be well dispersed together, while the polarity of the polymer matrix is taken into account. For the low-molecular organic compound the petroleum waxes and fatty acids are preferable.

These low-molecular organic compounds are commercially available, and commercial products may be immediately used.

In the present invention, one object of which is to provide a thermistor that can operate preferably at less than 200° C., and especially less than 100° C., the low-molecular organic compound used has preferably a melting point, mp, of 40 to 200° C., and preferably 40 to 100° C. Such a low-molecular organic compound, for instance, includes paraffin waxes (e.g., tetracosane $C_{24}H_{50}$ mp 49–52° C.; hexatriacontane $C_{36}H_{74}$ mp 73° C.; HNP-10 mp 75° C., Nippon Seiro Co., Ltd.; and HNP-3 mp 66° C., Nippon Seiro Co., Ltd.), microcrystalline waxes (e.g., Hi-Mic-1080 mp 83° C., Nippon Seiro Co., Ltd.; Hi-Mic-1045 mp 70° C., Nippon Seiro Co., Ltd.; Hi-Mic-2045 mp 64° C., Nippon Seiro Co., Ltd.; Hi-Mic-3090 mp 89° C., Nippon Seiro Co., Ltd.; Seratta 104 mp 96° C., Nippon Sekiyu Seisei Co., Ltd.; and 155 Microwax mp 70° C., Nippon Sekiyu Seisei Co., Ltd.), fatty acids (e.g., behenic acid mp 81° C., Nippon Seika Co., Ltd.; stearic acid mp 72° C., Nippon Seika Co., Ltd.; and palmitic acid mp 64° C., Nippon Seika Co., Ltd.), fatty esters (arachic methyl ester mp 48° C., Tokyo Kasei Co., Ltd.), and fatty amides (e.g., oleic amide mp 76° C., Nippon Seika Co., Ltd.). Use may also be made of polyethylene wax (e.g., Mitsui High-Wax 110 mp 100° C. made by Mitsui Petrochemical Industries, Inc.), stearic amide (mp 109° C.), behenic amide (mp 111° C.), N-N'-ethylene-bis-lauric amide (mp 157° C.), N-N'-dioleyladipic amide (mp 119° C.) and N-N'-hexamethylene-bis-stearic amide (mp 140° C.). Use may further be made of wax blends which comprise paraffin waxes and resins and may further contain microcrystalline waxes, and which have a melting point adjusted to 40 to 200° C.

The low-molecular organic compounds may be used alone or in combination of two or more although depending on operating temperature and so on.

The weight of the low-molecular organic compound used herein should be preferably 0.2 to 4 times, and more preferably 0.2 to 2.5 times, as large as the total weight of the thermosetting polymer matrix (including the curing agent, etc.). When this mixing ratio becomes lower or the amount of the low-molecular organic compound becomes smaller, no sufficient rate of resistance change is obtainable. When the mixing ratio becomes higher or the amount of the low-molecular organic compound becomes larger, on the contrary, does not only any large deformation of a thermistor element occur upon the melting of the low-molecular organic compound, but it is difficult to mix the low-molecular organic compound with the conductive particles.

The conductive particles used herein, each having spiky protuberances, are each made up of a primary particle having pointed protuberances. More specifically, a number of (usually 10 to 500) conical and spiky protuberances, each having a height of ⅓ to 1/50 of particle diameter, are present on one single particle. The conductive particles are preferably made up of Ni or the like.

Although such conductive particles may be used in a discrete powder form, it is preferable that they are used in a chain form of about 10 to 1,000 interconnected primary particles to form a secondary particle. The chain form of interconnected primary particles may partially include primary particles. Examples of the former include a spherical form of nickel powders having spiky protuberances, one of which is commercially available under the trade name of INCO Type 123 Nickel Powder (INCO Co., Ltd.). These powders have an average particle diameter of about 3 to 7 $\mu$m, an apparent density of about 1.8 to 2.7 g/cm$^3$, and a specific surface area of about 0.34 to 0.44 m$^2$/g.

Preferred examples of the latter are filamentary nickel powders, some of which are commercially available under the trade names of INCO Type 255 Nickel Powder, INCO Type 270 Nickel Powder, INCO Type 287 Nickel Powder, and INCO Type 210 Nickel Powder, all made by INCO Co., Ltd., with the former three being preferred. The primary particles have an average particle diameter of preferably at least 0.1 μm, and more preferably from about 0.5 to about 4.0 μm inclusive. Primary particles having an average particle diameter of 1.0 to 4.0 μm inclusive are most preferred, and may be mixed with 50% by weight or less of primary particles having an average particle diameter of 0.1 μm to less than 1.0 μm. The apparent density is about 0.3 to 1.0 g/cm$^3$ and the specific surface area is about 0.4 to 2.5 m$^2$/g.

In this regard, it is to be noted that the average particle diameter is measured by the Fischer subsieve method.

Such conductive particles are set forth in JP-A 5-47503 and U.S. Pat. No. 5,378,407.

In addition to the conductive particles having spiky protuberances, it is acceptable to use for the conductive particles carbon conductive particles such as carbon black, graphite, carbon fibers, metallized carbon black, graphitized carbon black and metallized carbon fibers, spherical, flaky or fibrous metal particles, metal particles coated with different metals (e.g., silver-coated nickel particles), ceramic conductive particles such as those of tungsten carbide, titanium nitride, zirconium nitride, titanium carbide, titanium boride and molybdenum silicide, and conductive potassium titanate whiskers disclosed in JPA's 8-31554 and 9-27383. The amount of such conductive particles should preferably be up to 25% by weight of the conductive particles having spiky protuberances.

The weight of the conductive particles used herein should preferably be 1.5 to 5 times as large as the total, weight of the thermosetting polymer matrix and low-molecular organic compound (the total weight of the organic components inclusive of the curing agent, etc.). When this mixing ratio becomes lower or the amount of the conductive particles becomes smaller, it is impossible to make the room-temperature resistance of the thermistor in a non-operating state sufficiently low. When the amount of the conductive particles becomes larger, on the contrary, it is not only difficult to obtain any large rate of resistance change, but it is also difficult to achieve any uniform mixing, resulting in a failure in obtaining any stabile performance.

Next, how to fabricate the organic positive temperature coefficient thermistor of the invention will be explained.

Given amounts of the thermosetting resin (not subjected to curing), curing agent or the like, low-molecular organic compound and conductive particles having spiky protuberances were mixed and dispersed together to obtain a paint form of mixture. Mixing and dispersion may be carried out in known manners using various stirrers, dispersers, mills, paint rolling machines, etc. If air bubbles are incorporated in the mixture, the mixture is then defoamed in vacuum. For viscosity control, various solvents such as aromatic hydrocarbon solvents, ketones and alcohols may be used. The mixture is cast between nickel, copper or other metal foil electrodes or such electrodes are coated by the mixture by means of screen printing, etc., to obtain a sheet. The sheet is cured under given heat-treating conditions for the thermosetting resin. At this time, the thermosetting resin may be pre-cured at a relatively low temperature, followed by curing at a high temperature. Alternatively, the mixture alone may be cured into a sheet form, on which a conductive paste or the like is then coated to form electrodes thereon. The obtained sheet is finally punched out into a desired shape to obtain a thermistor element.

The organic thermistor of the invention may contain various additives provided that they should be undetrimental to the performance intended by the invention. To prevent thermal degradation of the polymer matrix and low-molecular organic compound, for instance, an antioxidant may also be incorporated in the thermistor element. Phenols, organic sulfurs, phosphites (based on organic phosphorus), etc. may be used for the antioxidant.

Additionally, the thermistor of the invention may contain as a good heat- and electricity-conducting additive silicon nitride, silica, alumina and clay (mica, talc, etc.) described in JP-A 57-12061, silicon, silicon carbide, silicon nitride, beryllia and selenium described in JP-B 7-77161, inorganic nitrides and magnesium oxide described in JP-A 5-217711, and the like.

For robustness improvements, the thermistor of the invention may contain titanium oxide, iron oxide, zinc oxide, silica, magnesium oxide, alumina, chromium oxide, barium sulfate, calcium carbonate, calcium hydroxide and lead oxide described in JP-A 5-226112, inorganic solids having a high relative dielectric constant described in JP-A 6-68963, for instance, barium titanate, strontium titanate and potassium niobate, and the like.

For voltage resistance improvements, the thermistor of the invention may contain boron carbide described in JP-A 4-74383, etc.

For strength improvements, the thermistor of the invention may contain hydrated alkali titanate described in JP-A 5-74603, titanium oxide, iron oxide, zinc oxide and silica described in JP-A 8-17563, etc.

As a crystal nucleator, the thermistor of the invention may contain alkali halide and melamine resin described in JP-B 59-10553, benzoic acid, dibenzylidenesorbitol and metal benzoates described in JP-A 6-76511, talc, zeolite and dibenzylidenesorbitol described in JP-A 6-6864, sorbitol derivatives (gelling agents), asphalt and sodium bis(4-t-butylphenyl) phosphate described in JP-A 7-263127, etc.

As an arc-controlling agent, the thermistor of the invention may contain alumina and magnesia hydrate described in JP-B 4-28744, metal hydrates and silicon carbide described in JP-A 61-250058, etc.

As a preventive for the harmful effects of metals, the thermistor of the invention may contain Irganox MD1024 (Ciba-Geigy) described in JP-A 7-6864, etc.

As a flame retardant, the thermistor of the invention may contain diantimony trioxide and aluminum hydroxide described in JP-A 61-239581, magnesium hydroxide described in JP-A 5-74603, a halogen-containing organic compound (including a polymer) such as 2,2-bis(4-hydroxy-3,5-dibromophenyl)propane and polyvinylidene fluoride (PVDF), a phosphorus compound such as ammonium phosphate, etc.

In addition to these additives, the thermistor of the invention may contain zinc sulfide, basic magnesium carbonate, aluminum oxide, calcium silicate, magnesium silicate, aluminosilicate clay (mica, talc, kaolinite, montmorillonite, etc.), glass powders, glass flakes, glass fibers, calcium sulfate, etc.

The above additives should be used in an amount of up to 25% by weight of the total weight of the polymer matrix, low-molecular organic compound and conductive particles.

The organic positive temperature coefficient thermistor of the invention has low initial resistance in its non-operating state, as represented by a room-temperature specific resistance value of about $10^{-2}$ to $10^{0}$ Ω·cm, and shows a sharp resistance rise upon operation, with the rate of resistance change upon transition from its non-operating state to its operating state being 6 orders of magnitude greater.

EXAMPLE

The present invention will now be explained more specifically with reference to examples, and comparative

Example 1

Bisphenol A type epoxy resin (Epicoat 801 made by Yuka Shell Epoxy Co., Ltd.) and an modified amine type curing agent (Epomate B002 made by Yuka Shell Epoxy Co., Ltd.) were used for the thermosetting polymer matrix. Paraffin wax (HNP-10 made by Nippon Seiro Co., Ltd. with a melting point of 75° C.) was used as the low-molecular organic compound and filamentary nickel powders (Type 255 Nickel Powder made by INCO Co., Ltd.) was used as the conductive particles. The conductive particles had an average particle diameter of 2.2 to 2.8 $\mu$m, an apparent density of 0.5 to 0.65 g/cm$^3$, and a specific surface area of 0.68 m$^2$/g.

Twenty (20) grams of bisphenol A type epoxy resin, 10 grams of the modified amine type curing agent, 15 grams of paraffin wax (0.5 times as large as the total weight of the epoxy resin and curing agent), 180 grams of nickel powders (4 times as large as the total weight of the organic components) and 20 ml of toluene were mixed together in a centrifugal disperser for about 10 minutes. The obtained paint-like mixture was coated on one side of one 30 $\mu$m thick Ni foil electrode, and another Ni foil electrode was placed on the coated mixture. The sheet-like assembly was sandwiched between brass plates using a spacer to a total thickness of 1 mm. This was thermally cured at 80° C. for 3 hours while pressed in a thermo-pressing machine. The thus cured sheet assembly with the electrodes thermocompressed thereto was punched out to a disk of 1 cm in diameter to obtain an organic positive temperature coefficient thermistor element. As can be seen from FIG. 1 that is a sectional schematic of the thermistor element, a thermistor element sheet 12 that is the cured sheet containing the low-molecular organic compound, polymer matrix and conductive particles is sandwiched between Ni foil electrodes 11.

Figure 2:
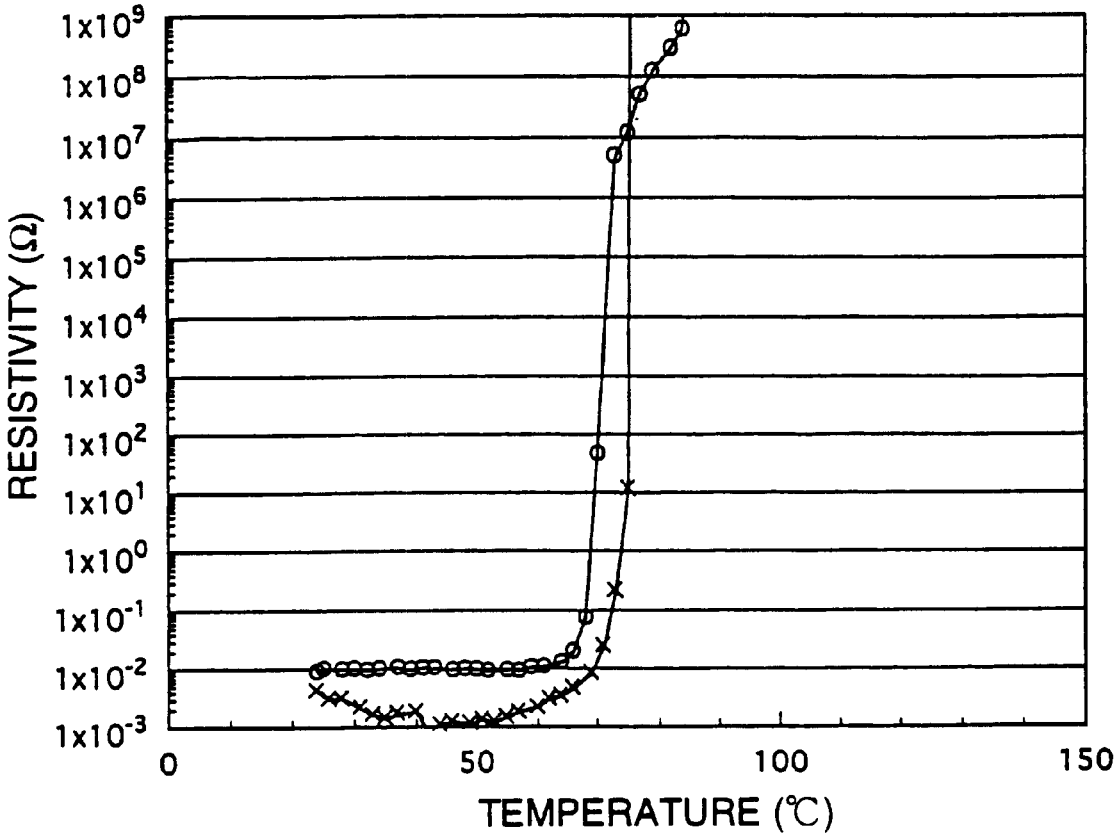
FIG. 2 is a temperature vs. resistance curve for the thermistor element according to Example 1.

In a thermostat the element was heated from room temperature (25° C.) to 120° C. and cooled down from 120° C. to room temperature, each at a rate of 2° C./min., and then measured for resistance value at a given temperature by the four-terminal method to obtain a temperature vs. resistance curve. The results are plotted in FIG. 2.

The element had an initial room-temperature (25° C.) resistance of $8.2\times10^3$ Ω($6.4\times10^2$ Ω·cm), and showed a sharp resistance value rise at around 75° C. or the melting point of the wax, with the rate of resistance change being orders of magnitude greater. Even when the heating of the element was continued to 120° C. after the resistance increase, no resistance decrease (NTC phenomenon) was observed. The temperature vs. resistance curve upon cooling was found to be substantially similar to that upon heating; the hysteresis was sufficiently reduced.

Example 2

Unsaturated polyester resin (G-110AL made by Nippon Shokubai Co., Ltd.) was used as the thermosetting polymer matrix, benzoyl peroxide (Kadox B-75W made by Kayaku Akuzo Co., Ltd.) as the organic peroxide, behenic acid (made by Nippon Seika Co., Ltd. with a melting point of 81° C.) as the low-molecular organic compound, and the same filamentary nickel powders (Type 255 Nickel Powder made by INCO Co., Ltd.) as in Example 1 as conductive particles.

Figure 3:
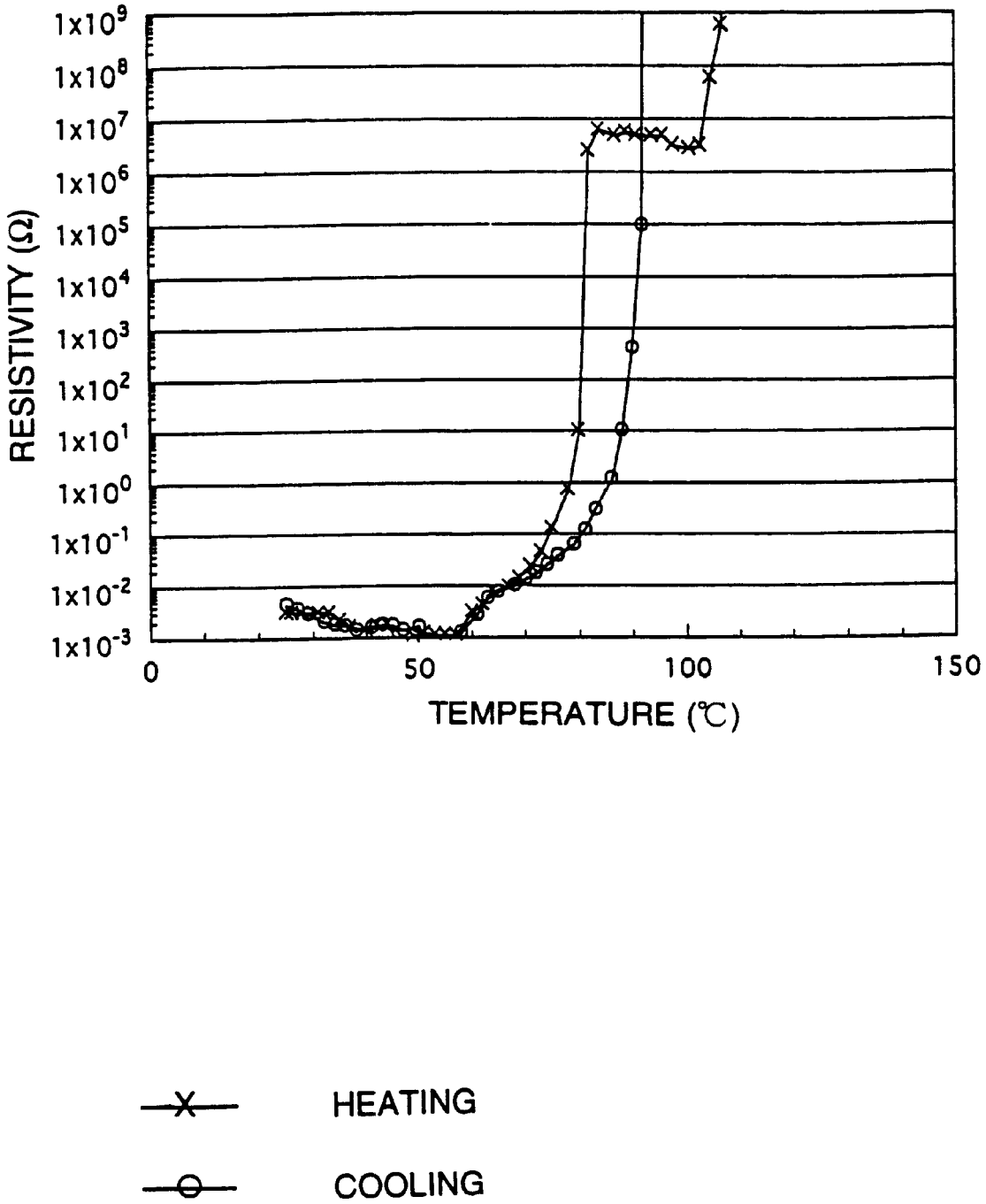
FIG. 3 is a temperature vs. resistance curve for the thermistor element according to Example 2.

Thirty (30) grams of the unsaturated polyester resin, 0.3 grams of benzoyl peroxide, 15 grams of behenic acid, 180 grams of the nickel powders and 20 ml of toluene were mixed together in a centrifugal disperser for about 10 minutes. The obtained paint-like mixture was coated on one side of one 30 $\mu$m thick Ni foil electrode, and another Ni foil electrode was placed on the coated mixture. The sheet-like assembly was sandwiched between brass plates using a spacer to a total thickness of 1 mm. This was thermally cured at 80° C. for 30 minutes while pressed in a thermo-pressing machine. The thus cured sheet assembly with the electrodes thermocompressed thereto was punched out to a disk of 1 cm in diameter to obtain an organic positive temperature coefficient thermistor element. Then, a temperature vs. resistance curve for this element was obtained as in Example 1. The results are plotted in FIG. 3.

The element had an initial room-temperature (25° C.) resistance of $5.0\times10^{-3}$ Ω($3.9\times10^{-2}$ Ω·cm), and showed a sharp resistance value rise at around 81° C. or the melting point of behenic acid, with the rate of resistance change being 8 orders of magnitude greater. Even when the heating of the element was continued to 120° C. after the resistance increase, little or no resistance decrease (NTC phenomenon) was observed. The temperature vs. resistance curve upon cooling was found to be substantially similar to that upon heating; the hysteresis was sufficiently reduced at about 10° C. By definition, the degree of hysteresis is the difference (absolute value) between the operating temperature defined by a point of intersection of tangents drawn to the temperature vs. resistance curve before and after operation and the operating temperature similarly found from the temperature vs. resistance curve upon cooling.

Example 3

A thermistor element was prepared as in Example 1 with the exception that curing was carried out at 150° C. for 1 hour and at 180° C. for 3 hours using 20 grams of polyaminobis-maleimide prepolymer (Kerimide B601 made by Ciba-Geigy) and 10 grams of dimethylformamide for the thermosetting polymer matrix in place of bisphenol A type epoxy resin and the modified amine type curing agent. By estimation, the thermistor element was found to be equivalent to the thermistor element obtained in Example 1.

Example 4

A thermistor element was prepared as in Example 1 with the exception that curing was carried out at 100° C. for 1 hour using 30 grams of polyurethane (Colonate by Nippon Polyurethane Co., Ltd.) for the thermosetting polymer matrix in place of bisphenol A type epoxy resin and the modified amine type curing agent. By estimation, the thermistor element was found to be equivalent to the thermistor element obtained in Example 1.

Example 5

A thermistor element was prepared as in Example 1 with the exception that curing was carried out at 120° C. for 3 hours using 30 grams of phenol resin (Sumicon PM made by Sumitomo Bakelite Co., Ltd.) for the thermosetting polymer matrix in place of bisphenol A type epoxy resin and the modified amine type curing agent. By estimation, the thermistor element was found to be equivalent to the thermistor element obtained in Example 1.

Example 6

A thermistor element was prepared as in Example 1 with the exception that curing was carried out at 100° C. for 1 hour using 30 grams of silicone rubber (TSE3221 made by Toshiba Silicone Co., Ltd.) for the thermosetting polymer matrix in place of bisphenol A type epoxy resin and the modified amine type curing agent. By estimation, the thermistor element was found to be equivalent to the thermistor element obtained in Example 1.

Comparative Example 1

Figure 4:
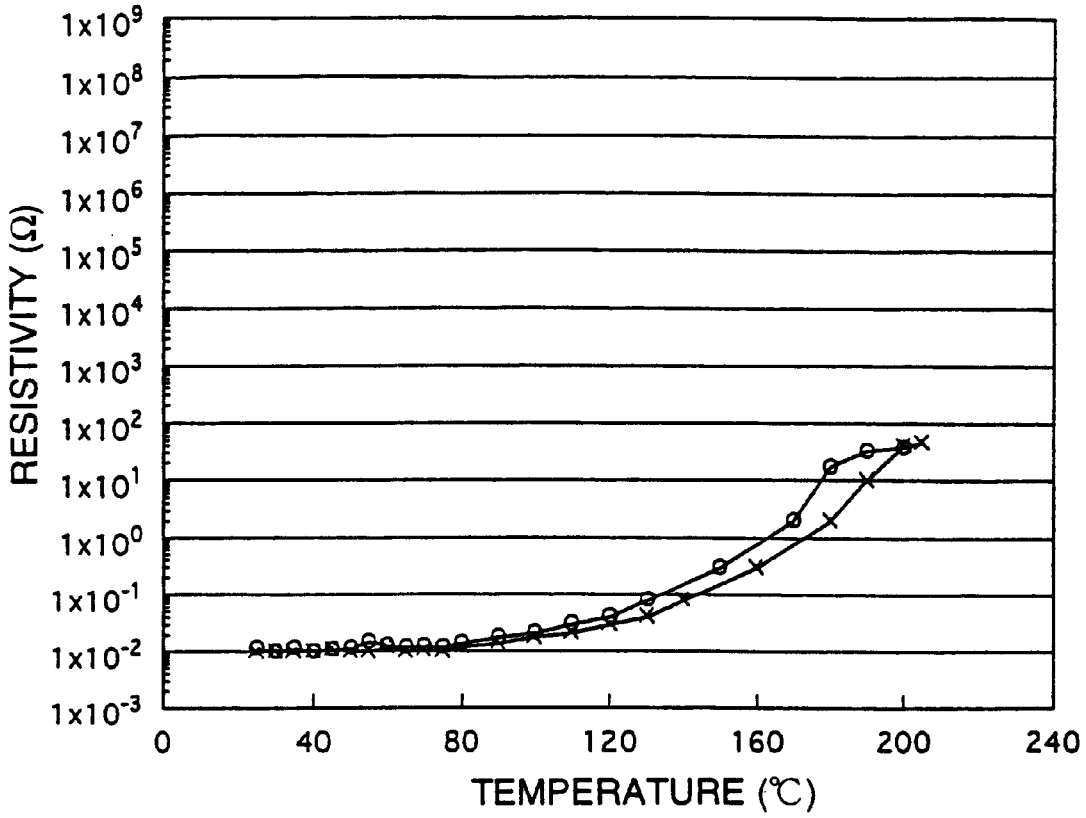
FIG. 4 is a temperature vs. resistance curve for the thermistor element according to Comparative Example 1.

A thermistor element was prepared as in Example 1 with the exception that no paraffin wax is used and the nickel powders were used in an amount of 4 times as large as the total weight of the epoxy resin and curing agent. Then, a temperature vs. resistance curve for this element was obtained as in Example 1. The results are plotted in FIG. 4.

The element had an initial room-temperature (25° C.) resistance of $8.8\times10^{-3}$ Ω($6.9\times10^{-2}$ Ω·cm). The resistance increased gradually from about 80° C. with no distinct transition temperature. In addition, the resistance value at 80° C. was 13 Ω, and the rate of resistance change was as low as 3.2 orders of magnitude.

Comparative Example 2

A thermistor element was prepared as in Example 1 with the exception that for the conductive particles carbon black (Toka Black #4500 made by Tokai Carbon Co., Ltd. with an average particle of 60 nm and a specific surface area of 66 $m^2/g$) was used in an amount of 0.3 times as large as the total weight of the epoxy resin, curing agent and paraffin wax, and then estimated as in Example 1.

The element had an initial room-temperature (25° C.) resistance of 7.2 Ω(56.5 Ω·cm), and showed a resistance value rise at around 75° C. or the melting point of the wax, with the rate of resistance change being 2.5 order of magnitude.

By increasing the amount of the carbon black to 0.5 times as large as the weight of the mixture, the room-temperature resistance could be lowered. However, there was observed a further decrease in the rate of resistance change. From this, the effect of the conductive particles having spiky protuberances is obvious.

EFFECTS OF THE INVENTION

According to the present invention, it is thus possible to provide an organic positive temperature coefficient thermistor that has sufficiently low resistance at room temperature and a large rate of resistance change between an operating state and a non-operating state, and can operate with a reduced temperature vs. resistance curve hysteresis, no NTC property after a resistance increase, ease of control of operating temperature, and high performance stability.

What we claim is:

1. An organic positive temperature coefficient thermistor comprising:

a thermosetting polymer matrix, a low-molecular weight organic compound, conductive particles, each particle having spiky protuberances;

wherein said spiky protuberances have a height of ⅓ to 1/50 of a diameter of the conductive particle; and wherein said low-molecular weight organic compound is present in an amount 0.2 to 2.5 times as large as said thermosetting polymer matrix.

2. The organic positive temperature coefficient thermistor according to claim 1, wherein said low-molecular weight organic compound has a melting point of 40 to 200° C.

3. The organic positive temperature coefficient thermistor according to claim 1, wherein said low-molecular weight organic compound has a molecular weight of 4,000 or lower.

4. The organic positive temperature coefficient thermistor according to claim 1, wherein said low-molecular weight organic compound is a petroleum wax or a fatty acid.

5. The organic positive temperature coefficient thermistor according to claim 1, wherein said thermosetting polymer matrix is selected from the group consisting of an epoxy resin, an unsaturated polyester resin, a polyimide, a polyurethane, a phenol resin, and a silicone resin.

6. The organic positive temperature coefficient thermistor according to claim 1, wherein said conductive particles are interconnected in a chain form.

7. The thermistor according to claim 1, wherein said low-molecular weight organic compound has a molecular weight of up to 1,000.

8. The thermistor according to claim 1, wherein said low-molecular weight organic compound has a molecular weight of 200 to 800.

9. The thermistor according to claim 1, wherein said low-molecular weight organic compound is selected from the group consisting of waxes, petroleum waxes, paraffin wax, microcrystalline wax, natural wax, vegetable wax, animal wax, mineral wax, fats, oils, solid fats, and mixtures thereof.

10. The thermistor according to claim 1, wherein said low-molecular weight organic compound is selected from the group consisting of hydrocarbon, straight-chain alkane hydrocarbon having 22 or more carbon atoms, fatty acids, fatty acid of a straight-chain alkane hydrocarbon having 12 or more carbon atoms, fatty ester, methylester of a saturated fatty acid having 20 or more carbon atoms, fatty amide, unsaturated fatty amide, oleic amide, arucic amide, aliphatic amine, aliphatic primary amine having 16 or more carbon atoms, higher alcohol, n-alkylalcohol having 16 or more carbon atoms, paraffin chloride, and mixtures thereof.

11. The thermistor according to claim 1, wherein each of said conductive particles comprises a primary particle having pointed protuberances.

12. The thermistor according to claim 1, further comprising a conductive particle selected from the group consisting of carbon black, graphite, carbon fibers, metallized carbon black, graphitized carbon black, metallized carbon fibers, spherical metal particles, flaky metal particles, fibrous metal particles, metal-coated particles, silver-coated nickel particles, ceramic conductive particles, tungsten carbide, titanium nitride, zirconium nitride, titanium carbide, titanium boride, molybdenum silicide, and potassium titanate whiskers.

13. The thermistor according to claim 12, wherein said conductive particles are present in an amount of up to 25% by weight based on the conductive particles having spiky protuberances.

14. The thermistor according to claim 1, wherein said thermosetting polymer matrix is selected from the group consisting of bisphenol A epoxy resin, unsaturated polyester resin, polyamilno-bis-maleimide/dimethyl formamide polymer, polyurethane, phenol resin, and silicone rubber.

15. The thermistor according to claim 1, wherein said conductive particles comprise filamentary nickel powder.

* * * * *